US007091713B2

(12) United States Patent
Erdélyi et al.

(10) Patent No.: US 7,091,713 B2
(45) Date of Patent: Aug. 15, 2006

(54) METHOD AND CIRCUIT FOR GENERATING A HIGHER ORDER COMPENSATED BANDGAP VOLTAGE

(75) Inventors: János Erdélyi, Dunakeszi (HU); András Vince Horváth, Budapest (HU)

(73) Assignee: Integration Associates Inc., Mountain View, CA (US)

( * ) Notice: Subject to any disclaimer, the term of this patent is extended or adjusted under 35 U.S.C. 154(b) by 271 days.

(21) Appl. No.: 10/836,750

(22) Filed: Apr. 30, 2004

(65) Prior Publication Data

US 2005/0242799 A1 Nov. 3, 2005

(51) Int. Cl.
*G05F 3/16* (2006.01)

(52) U.S. Cl. ..... 323/314; 323/907

(58) Field of Classification Search ..... 323/312, 323/313, 314, 315, 907; 327/538, 539, 540
See application file for complete search history.

(56) References Cited

U.S. PATENT DOCUMENTS 4,443,753 A * 4/1984 McGlinchey ..... 323/313
4,553,083 A * 11/1985 Yang ..... 323/313
5,349,286 A * 9/1994 Marshall et al. ..... 323/315
5,391,980 A 2/1995 Thiel et al.
5,767,664 A 6/1998 Price et al.
5,825,232 A 10/1998 Kimura et al.
5,909,136 A 6/1999 Kimura et al.
6,014,020 A * 1/2000 Kuttner ..... 323/317
6,016,051 A 1/2000 Can et al.
6,075,407 A * 6/2000 Doyle ..... 327/539
6,255,807 B1 * 7/2001 Doorenbos et al. ..... 323/314
6,791,307 B1 * 9/2004 Harrison ..... 323/312
6,794,856 B1 * 9/2004 Fernald ..... 323/313
6,891,358 B1 * 5/2005 Marinca ..... 323/316

* cited by examiner

*Primary Examiner*—Adolf Berhane
(74) *Attorney, Agent, or Firm*—Francissen Patent Law, P.C.; Vernon W. Francissen

(57) ABSTRACT

A method and circuit are shown for generating a higher order compensated bandgap voltage is disclosed, in which a first order compensated bandgap voltage and a linearly temperature dependent voltage are generated. Thereafter, a difference between the linearly temperature dependent voltage and the first order compensated bandgap voltage is generated. The resulting difference voltage is squared, and finally the squared voltage is added to the first order compensated bandgap voltage, resulting in a higher order compensated bandgap voltage. There is also disclosed a higher order temperature compensated bandgap circuit.

33 Claims, 7 Drawing Sheets

40 + 50

Fig. 11
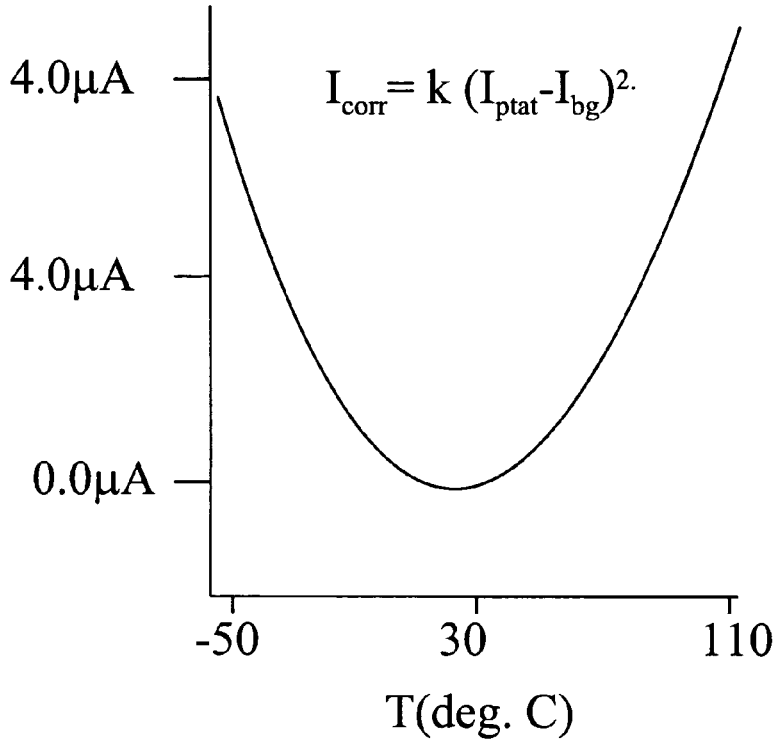
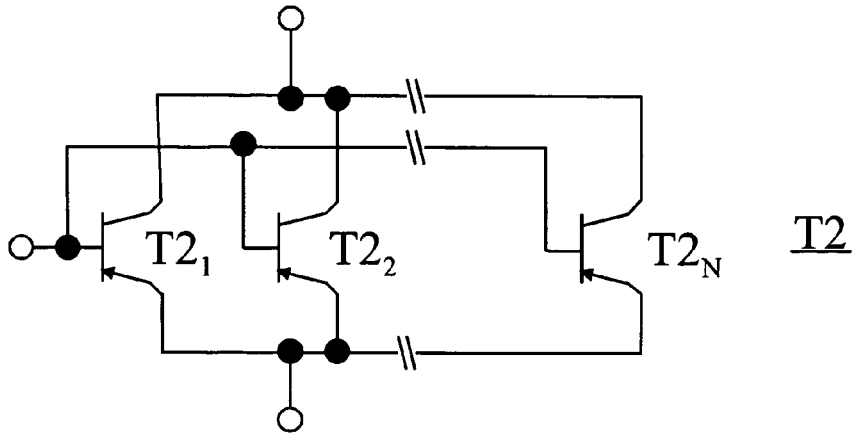
Fig. 8

METHOD AND CIRCUIT FOR GENERATING A HIGHER ORDER COMPENSATED BANDGAP VOLTAGE

FIELD OF THE INVENTION

The invention relates generally to generating a reference voltage and more particularly to a method and circuit for generating a higher order compensated bandgap voltage.

BACKGROUND OF THE INVENTION

There are many electronic devices on the market today that require a precise and reliable reference voltage that is stable over a wide temperature range. Such electronic devices include cameras, personal digital assistants (PDAs), cell phones, and digital music players. While there are circuits available for addressing this need, many suffer from problems. In particular, there is a need for relatively simple method and circuit for correcting the output voltage of a bandgap voltage reference source that achieves higher order compensation.

SUMMARY OF THE INVENTION

In an embodiment of the invention, there is provided a method for generating a higher order compensated bandgap voltage, in which a first order compensated bandgap voltage and a linearly temperature dependent voltage are generated. A difference voltage that is based on the difference between the linearly temperature dependent voltage and the first order compensated bandgap voltage is also generated. The resulting difference voltage is squared, and the squared voltage is added to the first order compensated bandgap voltage, resulting in a higher order compensated bandgap voltage.

In another embodiment, a first order compensated bandgap current that is proportional to the first order compensated bandgap voltage and a linearly temperature dependent current are generated. A difference current that is based on the difference between the linearly temperature dependent current and the first order compensated bandgap current is also generated. The difference current is squared to create a squared current, which is converted to a voltage.

According to an aspect of the invention, the linearly temperature dependent current is generated by converting the linearly dependent voltage to current.

In various embodiments of the invention, the linearly dependent current may be an $I_{ptat}$ current of a transistor. The transistor may a bipolar transistor that has the same structure a bipolar transistor of the first order compensated bandgap voltage generating circuit, and may, in fact, be one of the transistors of the first order compensated bandgap voltage generating circuit. The $I_{ptat}$ current may be jointly generated by a plurality of bipolar transistors, and may flow through a resistor to generate a $V_{ptat}$ voltage across the resistor.

In another embodiment of the invention, the linearly dependent voltage or the first order compensated bandgap voltage, or both may be amplified so that the linearly temperature dependent voltage and the first order compensated bandgap voltages are substantially equal in a central region of a compensation temperature range.

According to an aspect of the invention, the first order compensated bandgap voltage may be generated with a circuit comprising one or more bipolar transistors.

In another embodiment of the invention, there is provided a higher order temperature compensated bandgap circuit.

The bandgap circuit comprises a first order temperature compensated bandgap circuit, which generates a first order temperature compensated output voltage. The circuit further comprises a current generator circuit, which generates a linearly temperature dependent current, such as an $I_{ptat}$ current. The circuit further comprises a voltage to current converter circuit, which converts to current the first order temperature compensated output voltage and thereby provides a first order temperature compensated bandgap current. The circuit also comprises a multiplier circuit, such as a four quadrant multiplier, which is adapted for squaring a difference between said first order temperature compensated bandgap current and said linearly temperature dependent current, and thereby provides a squared current output. The circuit further comprises a current to voltage converter circuit, which converts to voltage the squared current output of the multiplier circuit, and thereby provides a squared voltage output. Finally, the circuit also comprises an adder circuit, which adds the squared voltage output of the current to voltage converter circuit to the first order temperature compensated output voltage of the first order temperature compensated bandgap circuit. The linearly temperature dependent current and the first order compensated bandgap current may each be fed through the respective resistors of a pair of substantially equal resistors. The first order temperature compensated bandgap circuit may include a first transistor generating a first $I_{ptat}$ current and a second transistor generating a second $I_{ptat}$ current. The first or second transistor may be a bipolar transistor.

According to another embodiment of the invention, the bandgap circuit further comprises a differential voltage input circuit for generating a differential voltage from the linearly temperature dependent current of said current generator and the first order compensated bandgap current of the voltage to current converter circuit.

According to yet another embodiment of the invention, the bandgap circuit may comprise means for amplifying at either or both of the first order compensated bandgap current and the linearly temperature dependent current so that the first order compensated bandgap current and the linearly temperature dependent current are substantially equal to the other current in a central region of a compensation temperature range. The bandgap circuit may further include either a bandgap current setting resistor or a $I_{ptat}$ current setting resistor, or both. The voltage to current converter circuit may include an op-amp, which establishes a voltage across a resistor, and thereby generates a current through the resistor. The first order temperature compensated circuit may include a transistor, which also generates the linearly temperature dependent current. The multiplier circuit may include a four quadrant multiplier In still another embodiment of the invention, a linearly temperature dependent voltage may be generated in the circuit with two transistors having different active areas, where two equal $I_{ptat}$ currents flowing through the two transistors establish different basis-emitter voltages on the two transistors, and a difference between the basis-emitter voltages is transformed across a resistor fed with a linearly temperature dependent current. The linearly temperature dependent current being fed through the resistor may be the $I_{ptat}$ current flowing through one of the transistors. The transistor having a larger active area of the two may, in fact, be a plurality of separate and parallel connected transistors

BRIEF DESCRIPTION OF DRAWINGS

The invention will be now described with reference to the enclosed drawings, where:

FIG. 8 illustrates the arrangement of multiple parallel connected transistors in the circuit of FIG. 6.

FIG. 11 illustrates the temperature dependence of the $I_{corr}$ current generated in the circuit of FIG. 6.

DETAILED DESCRIPTION OF THE INVENTION

Figure 1:
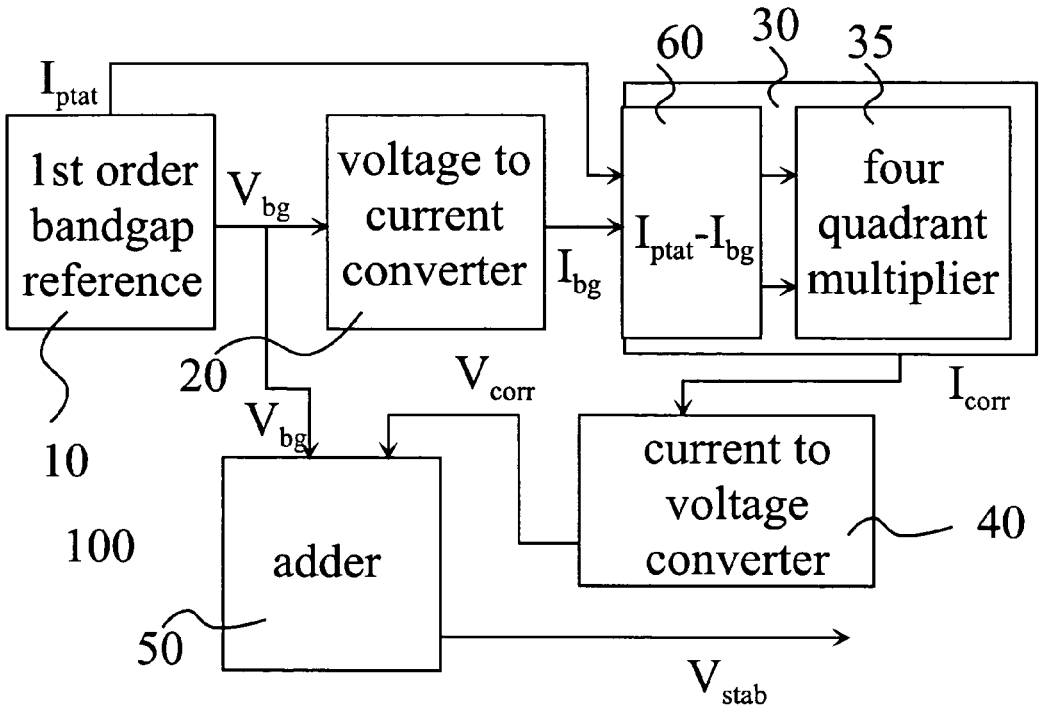
FIG. 1 is a functional block diagram of an exemplary embodiment of a higher order compensated bandgap voltage circuit according to the invention.

There are a number of ways to provide a reference voltage. One way is by using a bandgap (BG) reference circuit. In a bandgap reference circuit, the forward bias voltage difference of two identically doped p-n junctions (e.g. the base-emitter diode of bipolar transistors) operating at different current densities is exactly proportional to the absolute temperature (PTAT). This voltage difference is usually referred to as $V_{ptat}$. In contrast, the forward bias voltage itself has substantially linear and negative temperature dependence. By creating a properly weighted sum of these two voltages, their temperature dependencies cancel, and the output is substantially temperature independent. Such a circuit will be referred to hereinafter as a "first order compensated bandgap circuit" and the voltage will be called the bandgap voltage $V_{bg}$. Either voltage can be used (in conjunction with a reference resistor) to generate currents with the same temperature dependency: $I_{ptat}$ or $I_{bg}$.

A first order compensated bandgap circuit as described above does not provide a completely temperature independent voltage. Higher order terms are still present, and on a closer examination, it appears that the temperature dependence of the voltage is close to parabolic, e. g. in a –40–120° C. temperature range the voltage variation could amount to a few mV. There are certain applications, such as high-resolution A/D converter or D/A converter circuits, where the temperature dependence of the reference voltage seriously affects the precision of the converter.

A first order bandgap reference may be further corrected, in order to obtain an even more stable reference. For example, a bandgap reference circuit can be corrected by forming a current that is proportional to the absolute temperature. This current may then be fed to a translinear cell in a squaring transformation. The resulting squared current is then divided by a (relatively) temperature independent current. This current is adjusted and injected to the bandgap circuit to cancel the second order terms of the temperature dependence of the bandgap voltage. Such a circuit is capable of reducing the variation of the reference voltage to approx. 5 mV in a temperature range of approx. 200° C. However, some problems remain. First, the effect of the remaining and non-compensated higher order components is still significant. Effectively, the final compensated voltage shows a third order temperature dependence. Second, the circuit is relatively prone to noise because the injected correcting current is quite significant, particularly at higher temperatures. Due to the applied principle, the correcting current is non-zero even in the middle of the temperature range. Third, this method does not lend itself to achieving higher order compensation greater than a second order because, continuing with the same principle, it would be necessary to generate not only a squared, but a third order current. The potential added error of such a third order generated current would likely surpass that of the error to be corrected.

The present invention is capable of generating a stabilized voltage output within approximately 1 mV or less of a nominal output voltage. This stabilized voltage may be obtained with circuitry containing only standard analog electronic components, such as bipolar and field effect transistors (FETs), and resistors. No transformation on a higher order than squaring needs to be performed by analog components of the circuit and yet the achieved stabilized voltage output shows at least third order compensation. The circuit is well suited for high-level integration in a chip, requiring approx. 50 transistors or less. The matching and tolerance requirements of the circuit do not exceed those of known compensated bandgap circuits.

Turning now to FIG. 1, there is shown a functional block diagram of one embodiment of a higher order compensated bandgap circuit 100 according to an embodiment of the invention. An embodiment of a method, according to the present invention, will also be explained as part of a discussion on how the bandgap circuit 100 operates.

The bandgap circuit 100 has the following functional units: A basic block in the circuit 100 is a known first order temperature compensated bandgap circuit 10. The primary function of the bandgap circuit 10 is the generation of a first order temperature compensated output voltage, namely the bandgap voltage $V_{bg}$. As will be explained below, the bandgap circuit 10 also acts as a current generator circuit which generates a linearly temperature dependent current. In the embodiment shown in the figures, this linearly temperature dependent current is an $I_{ptat}$ current of a transistor within the bandgap reference circuit 10, i.e. a proportional to absolute temperature current. However, as is known in the art, there are a variety of circuits that may be employed to generate a linearly temperature dependent current, which may be used in place of the bandgap circuit 10.

The bandgap voltage $V_{bg}$ is input into the voltage to current converter circuit 20, which subsequently converts the bandgap voltage $V_{bg}$ to a bandgap current $I_{bg}$. Specifically, it generates a bandgap current $I_{bg}$ that is proportional to the bandgap voltage $V_{bg}$, and in this manner it may be regarded as a first order temperature compensated bandgap current. Otherwise, the bandgap current $I_{bg}$ has no direct physical function related to the operation of the bandgap circuit 10. The amplitude of the bandgap current $I_{bg}$ is determined by the parameters of the voltage to current converter circuit 20.

The bandgap current $I_{bg}$ output from the voltage to current converter circuit 20 and the $I_{ptat}$ current output from the bandgap circuit 10 are fed into a multiplier circuit 30. The function of the multiplier circuit 30 is to generate a difference between the bandgap current $I_{bg}$ and the $I_{ptat}$ current, e.g. $(I_{bg}-I_{ptat})$, and then multiply the difference with itself, i.e. in effect to square the difference between bandgap current $I_{bg}$ and the $I_{ptat}$ current. The output of the multiplier circuit 30 is a correcting current $I_{corr}$ that is proportional to the square of the $(I_{bg}-I_{ptat})$ difference value.

In the embodiment shown in FIG. 1, the multiplier circuit 30 includes a four-quadrant multiplier circuit 35, with voltage inputs and a current output. The multiplier circuit 30 also includes a differential voltage input circuit 60, which generates a differential voltage from the bandgap current $I_{bg}$ and the $I_{ptat}$ current, so that two complementary $V_{in,a}$, $V_{in,b}$ differential input voltages are fed onto the inputs of the four-quadrant multiplier circuit 35, where $V_{in,a}=V_{in,b}\sim(I_{bg}-I_{ptat})$. In this manner the multiplier circuit 30 generates the $I_{corr}\sim(I_{bg}-I_{ptat})^2$ correcting current.

The current to voltage converter circuit 40 converts the correcting current $I_{corr}$ to a correcting voltage $V_{corr}$, which may be considered as a squared voltage (in the sense that its value is proportional to a square of the difference between the original bandgap voltage $V_{bg}$ output from the bandgap circuit 10) and a linearly temperature dependent voltage derived from the $I_{ptat}$ current (the latter itself being a linearly temperature dependent current).

The output of the higher order compensated bandgap circuit 100, the stabilized voltage $V_{stab}$, is established in the adder circuit 50, which adds the correcting voltage $V_{corr}$ to the original bandgap voltage $V_{bg}$.

Substantially, the bandgap circuit 100 performs the following: First, a first order compensated bandgap voltage and a linearly temperature dependent voltage are generated. Thereafter, a difference between the linearly temperature dependent voltage and the first order compensated bandgap voltage is generated, resulting in a difference voltage. The resulting difference voltage is then squared, and the squared voltage is added to the first order compensated bandgap voltage. In a practical embodiment, taking into consideration the possibilities of performing mathematical transformations with voltages through hardware, i. e. analog electronic components, the steps of generating the difference between the linearly temperature dependent voltage and the first order compensated bandgap voltage and squaring the resulting voltage are in fact realized by generating a current proportional to the first order compensated bandgap voltage, thereby generating a first order compensated bandgap current, while simultaneously generating a linearly temperature dependent current. Thereafter, a difference between the currents is established and the resulting difference current is squared. Finally, the resulting squared current is converted to a squared voltage.

FIGS. 2–5 are circuit diagrams illustrating examples of implementations of the component parts of the higher order compensated bandgap circuit 100 of FIG. 1. FIG. 6 is a circuit diagram illustrating one embodiment of a complete bandgap circuit, with some further details of the circuit explained with reference to FIGS. 7 and 8. FIGS. 9–13 illustrate the current and voltage values of the circuit shown in FIG. 6 as a function of temperature.

Figure 2:
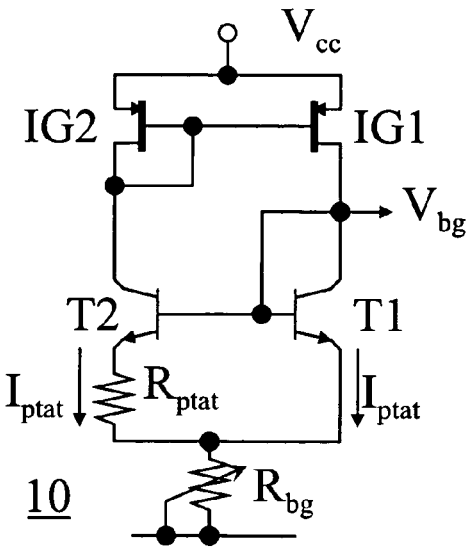
FIG. 2 is a functional circuit diagram of a part of the circuit of FIG. 1.

The working principle of the first order compensated bandgap circuit 10 is explained with the schematic shown in FIG. 2. In the bandgap circuit 10, a linearly temperature dependent voltage is generated with two transistors T1, T2 having different sized active regions. Two equal $I_{ptat}$ currents flowing through the two different transistors T1, T2 establish different basis-emitter voltages on the two transistors T1, T2, and a difference between the basis-emitter voltages is transformed across a resistor into a linearly temperature dependent current, which, in practice, is an $I_{ptat}$ current. In more detail, the bandgap circuit 10 has a first transistor T1, which has a $V_{be,1}$ voltage across its basis-emitter junction. The $V_{be}$ voltage is a voltage with substantially linear, negative absolute temperature dependence. The $I_{ptat}$ current is a so-called proportional to absolute temperature current, and the same $I_{ptat}$ current is mirrored to flow through transistor T2 by the current mirror represented by the current generators IG1 and IG2, which are shown here as FETs. The transistor T2 is larger than T1. The active region of the two transistors being different, the same $I_{ptat}$ current will generate a smaller $V_{be,2}$ voltage across the transistor T2, and at the same time a voltage $V_{ptat}=V_{be,1}-V_{be,2}$ across the resistor $R_{ptat}$. The two $I_{ptat}$ currents through T2 and T1 will develop a voltage $V_{Rbg}$ across the resistor $R_{bg}$. Since the $I_{ptat}$ currents have positive temperature dependence, the voltage $V_{Rbg}$ will also have positive temperature dependence. The output of the circuit, the first order corrected bandgap voltage $V_{bg}$, will thus be $V_{bg}=V_{be,2}+2*I_{ptat}*R_{bg}$. By tuning one or both of the $R_{ptat}$ or $R_{bg}$ resistors, the $V_{ptat}$ and the $V_{R,bg}$ voltages may be tuned, until the positive and negative temperature dependencies of $V_{be,2}$ and $V_{R,bg}$ cancel. As a result, the first order compensated bandgap voltage $V_{bg}$ will be substantially independent of temperature. This can be seen in FIG. 13, which shows the temperature dependence of the bandgap voltage $V_{bg}$ appearing at the nodes N1, N2 of the circuit 200 of FIG. 6.

One embodiment of the basic bandgap circuit 10 shown in FIG. 2 is shown implemented in the circuit 200 of FIG. 6 with transistors T1 and T2, which are bipolar transistors. The gates of the transistors T1 and T2 are brought to the same voltage by the operational amplifier OA1, the output of which drives current generators IG1 and IG2. Since the gates of the current generators IG1 and IG2 are connected, an equal $I_{ptat}$ current is forced through transistor T2 and transistor T1. The transistor T2 can made larger by connecting N transistors in parallel, an example of which is shown in FIG. 8. In this manner, the active area of T2 is larger than that of T1 by a factor of N. In one embodiment, N=20. This means that the twenty bipolar transistors $T2_1$–$T2_N$ constituting the transistor T2 jointly generate a $I_{ptat}$ current, and the generated $I_{ptat}$ current flows through the resistor $R_{ptat}$ to generate a $V_{ptat}$ voltage across the resistor $R_{ptat}$. It can be shown that the value of $V_{ptat}$ is proportional to the difference of the basis-emitter voltage $V_{be1}$ of the transistor T1, and the average basis-emitter voltage $V_{beN}$ of the transistors $T2_1$–$T2_N$, i. e. $V_{beN}-V_{be1}$, where $V_{beN}-V_{be1}=U_T$ In N, ($U_T\approx25$ mV on approx. 20° C.). The value of N=20 was selected because twenty transistors may be connected in parallel relatively easily on a chip. However, due to the logarithmic increase of the $V_{ptat}$ value as a function of N, it is preferable not to use much more than twenty bipolar transistors for the transistor T2.

Figure 7:
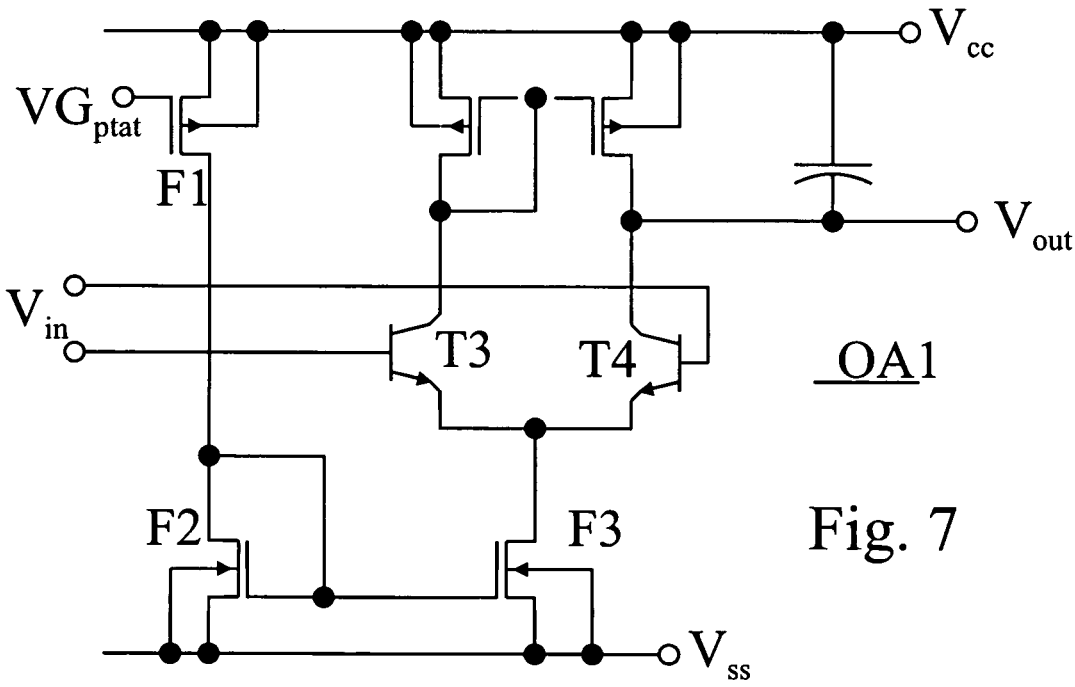
FIG. 7 is a simplified circuit diagram of an op-amp of the circuit of FIG. 6.

One possible embodiment of the op-amp OA1 is shown in FIG. 7. Note that the transistors T3,T4 in the op-amp OA1 are also biased through the current generator F1 with the gate voltage $VG_{ptat}$ driving the current generators IG1 and IG2 of the bandgap circuit 10, which, in turn, generate the $I_{ptat}$ current of the first order corrected bandgap circuit 10.

Therefore, $VG_{ptat}$ is also a linearly temperature dependent voltage, and $VG_{ptat} \sim I_{ptat}$. This fact is also exploited in the circuit 200, as will be shown below, because $VG_{ptat}$ may be used directly to mirror the $I_{ptat}$ current onto the input stage of the multiplier circuit 30.

Returning to FIG. 1, the voltage to current converter circuit 20 transforms the bandgap voltage $V_{bg}$ into a bandgap current $I_{bg}$. This is done by forcing a current through a resistor with the bandgap voltage $V_{bg}$. In the embodiment shown in FIG. 6, the voltage to current converter circuit 20 includes the op-amp $OA_2$, which establishes the voltage $V_{bg}$ output from the first order compensated bandgap circuit 10 across the resistor $R_{bg,trim}$, and thereby generates a bandgap current $I_{bg}$ through resistor $R_{bg,trim}$. The output of the op-amp $OA_2$ will drive the gate of the current generator IG3 until the inputs of the op-amp $OA_2$ are on the same voltage level. The bandgap current $I_{bg}$ may be adjusted by trimming the resistor $R_{bg,trim}$.

Figure 9:
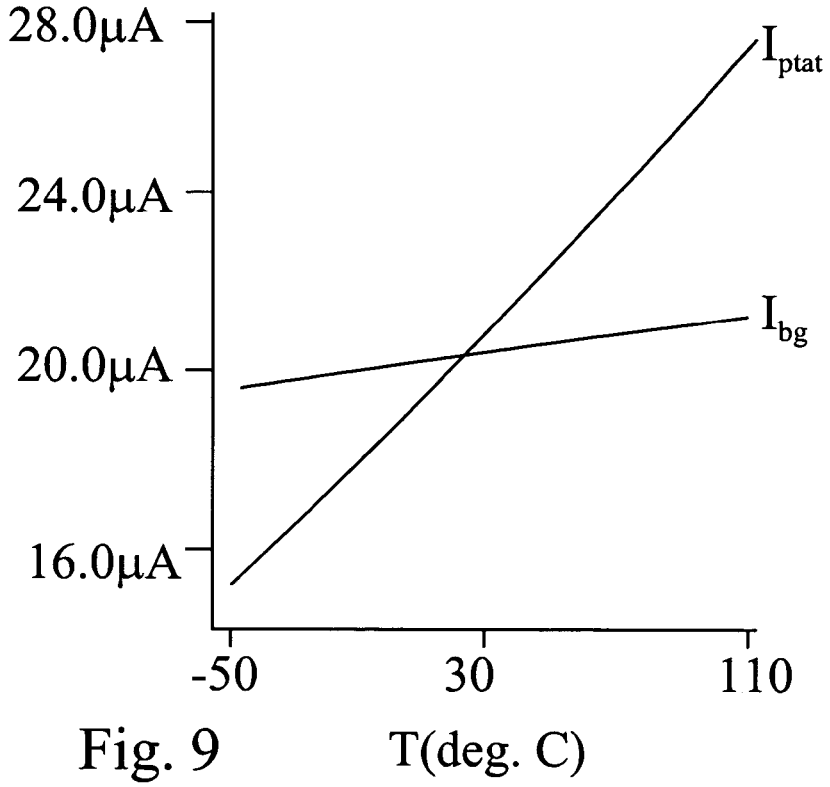
FIG. 9 illustrates the temperature dependence of the $I_{ptat}$ and $I_{bg}$ currents generated in the circuit of FIG. 6
Figure 10:
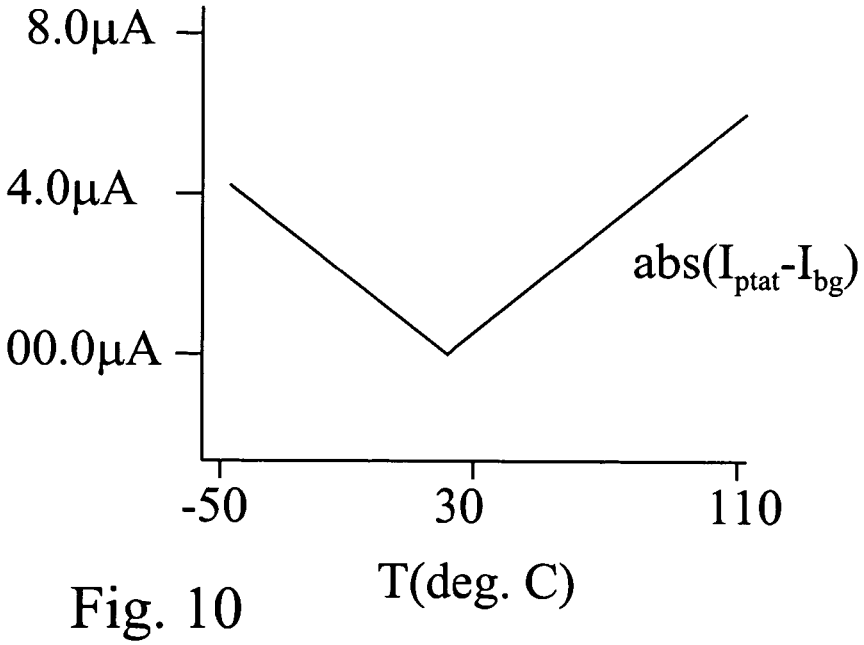
FIG. 10 illustrates the temperature dependence of the abs ($I_{ptat}$–$I_{bg}$) function of the $I_{ptat}$ and $I_{bg}$ currents generated in the circuit of FIG. 6.

The bandgap current $I_{bg}$ is tuned with the resistor $R_{bg,trim}$ to be substantially equal to the $I_{ptat}$ current in a central region of a compensation temperature range, for example at approx. 25° C., as shown in FIG. 9. It is noted that it is also possible to adjust the $I_{ptat}$ current with the setting resistors $R_{ptat}$ and $R_{bg,trim}$ in the bandgap circuit 10. Since it is a difference of the bandgap current $I_{bg}$ and the $I_{ptat}$ current that is subsequently squared by the multiplier circuit 30, it may be appreciated by those skilled in the art that it is the absolute value of this difference that really counts. Through the appropriate selection of the resistors $R_{ptat}$ and $R_{bg}$, the quantity $abs(I_{ptat}-I_{bg})$ may be conveniently tuned to have a value of zero in any predetermined point in the temperature interval where the additional compensation must be achieved, such as in a central region of the temperature range. This means that the correction factor, hence the potential noise, may be minimized in any selected region of the compensation range. This is also shown in FIG. 10, which illustrates the quantity $abs(I_{ptat}-I_{bg})$ as a function of temperature.

In order to have good matching of the bipolar transistors, it is desirable for the bipolar transistor generating the $I_{ptat}$ current to have the same structure as the bipolar transistors that generate the bandgap voltage $V_{bg}$. However, it is also desirable that these transistors not only have the same structure, but that the bipolar transistor generating the $I_{ptat}$ current be one of the bipolar transistors that generates the bandgap voltage $V_{bg}$, namely the transistor T1, which determines both the bandgap voltage $V_{bg}$ and the $I_{ptat}$ current.

Figure 3:
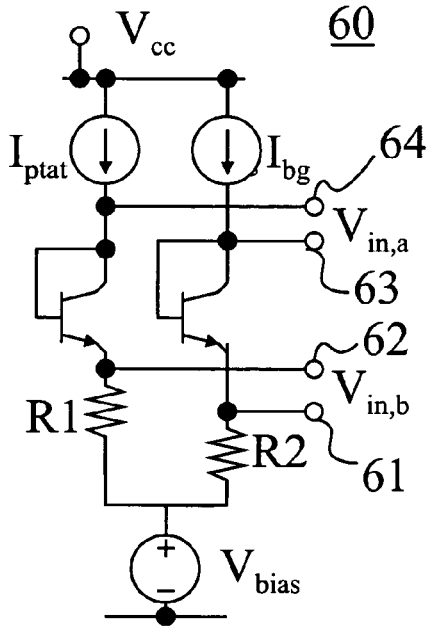
FIG. 3 is a functional schematic diagram of another part of the circuit of FIG. 1.

The difference current $(I_{ptat}-I_{bg})$ is transformed to an input voltage in the differential voltage input circuit 60. As shown in FIG. 3, in the differential voltage input circuit 60, the $I_{ptat}$ current and the bandgap current $I_{bg}$ are each fed through the respective resistors R1,R2 of a resistor pair. The resistors R1,R2 are equal, and will form a voltage proportional to the current across the resistors R1,R2. Accordingly, an input voltage $V_{in,b} \sim (I_{ptat}-I_{bg})$ appears on the nodes 61,62. Another input voltage $V_{in,a}=V_{in,b}$ will be formed on nodes 63,64, on a higher potential according to the base-emitter voltage of the transistors T5 and T6. The higher potential voltage is generated is because, as shown below, the four quadrant multiplier 35 also has inputs which require different bias levels (base level of the input voltage). The differential voltage input circuit 60 is also shown in FIG. 6. The $I_{ptat}$ and $I_{bg}$ currents are generated by the current generators IG5 and IG4, respectively, which mirror the $I_{ptat}$ current from the current generators IG1–IG2 of the basic bandgap circuit 10, and the $I_{bg}$ current from the current generator IG3 of the current to voltage converter circuit 20. The bias voltage generator $V_{bias}$ of FIG. 3 may be realized, in one embodiment shown in FIG. 6, by the FET F4, and it adjusts the bias point of the transistors T5,T6.

Figure 5:
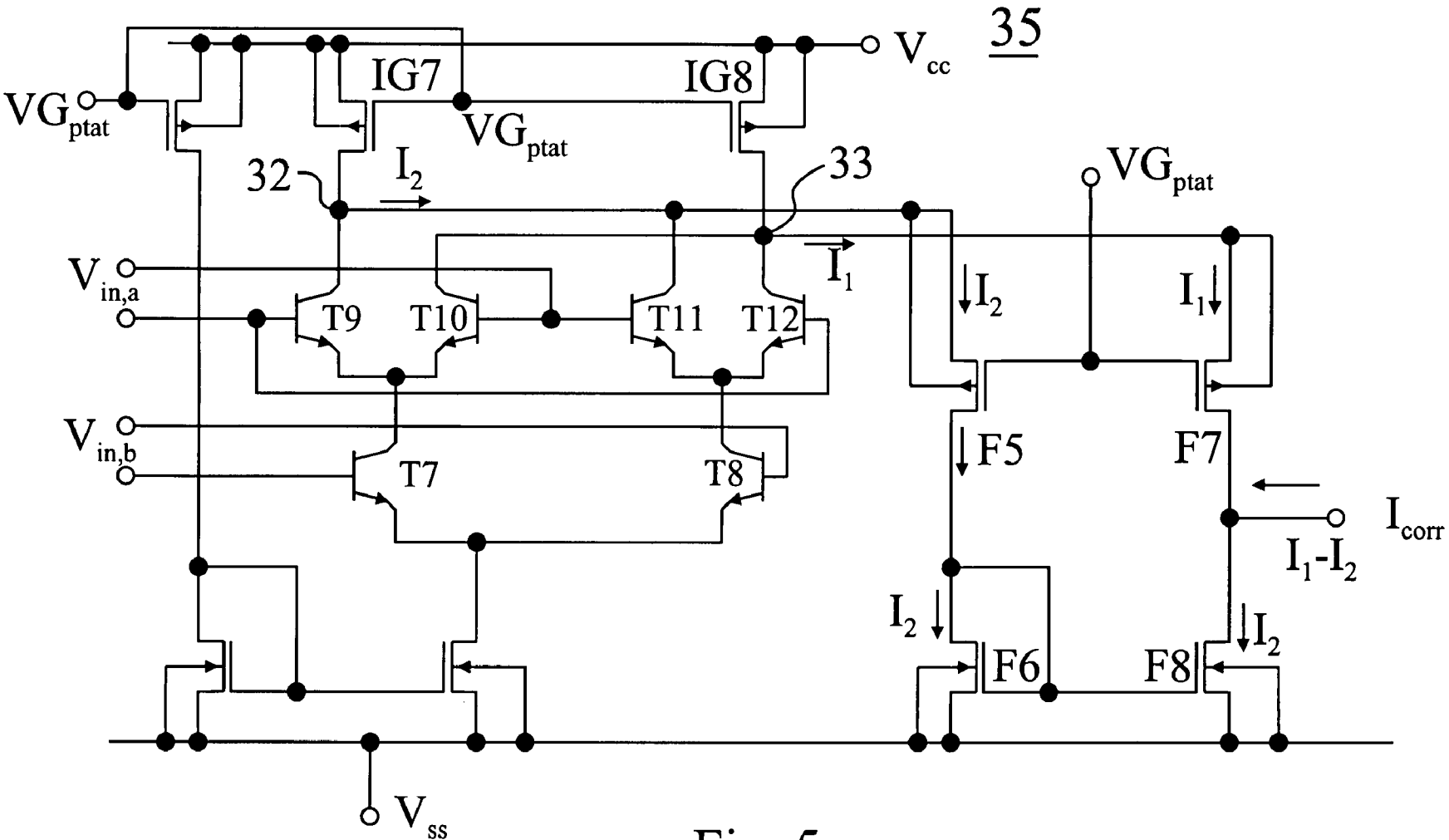
FIG. 5 is a functional schematic diagram of a further part of the circuit of FIG. 1.
Figure 6:
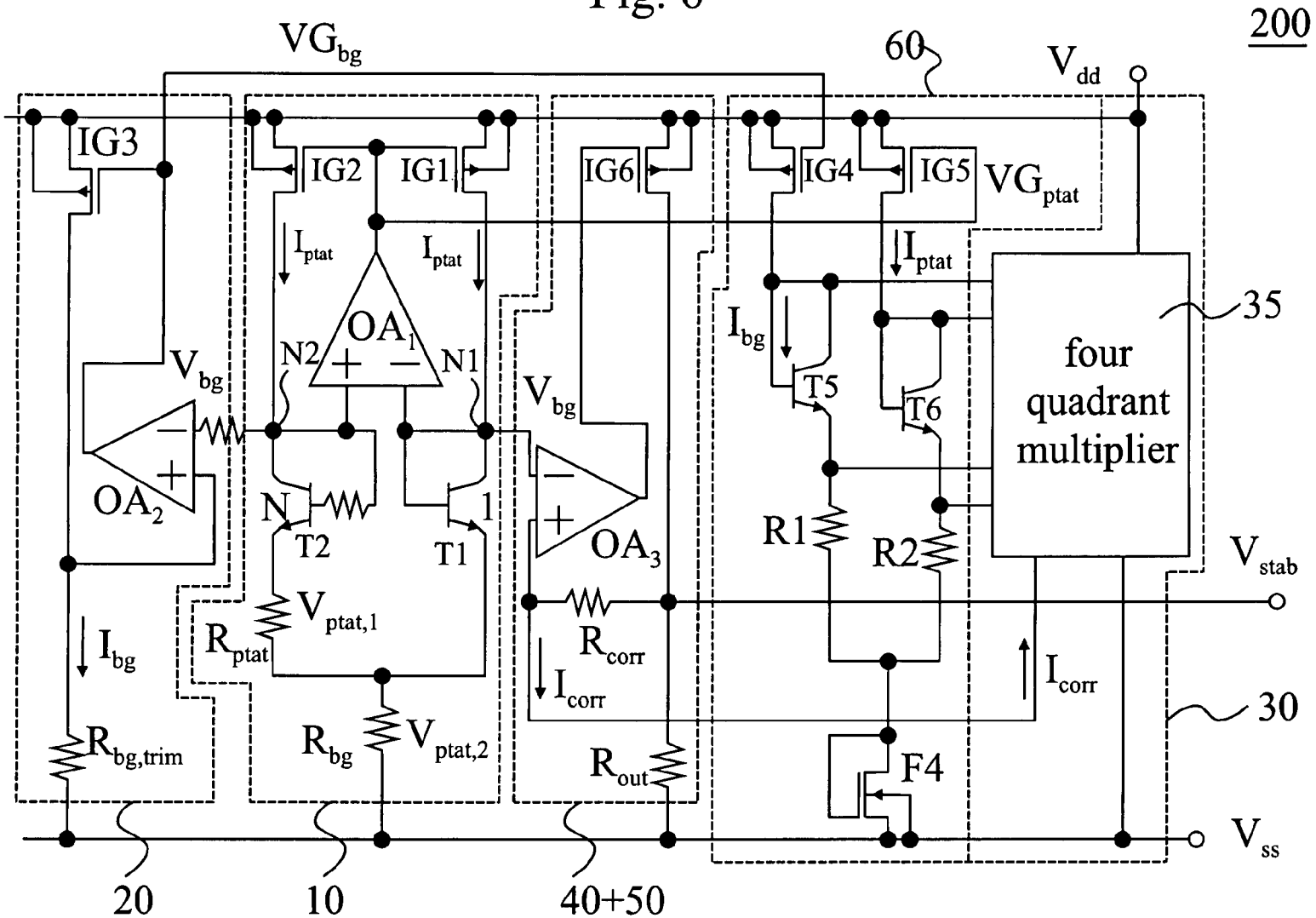
FIG. 6 is a simplified circuit diagram of an embodiment of a higher order compensated bandgap voltage circuit according to the invention, performing the functions of the block diagram of FIG. 1.

FIG. 5 shows one possible embodiment of the four quadrant multiplier 35 of the multiplier circuit 30 of FIG. 1. It is noted that the bias point of the transistors T7, T8 is also tuned from the gate voltage $VG_{ptat}$, which tunes the bias of the op-amp $OA_1$ shown in the embodiment of FIG. 6 and further illustrated in FIG. 7. The actual multiplier is constituted by two sets of two-level cascaded transistors T7, T8, T9, T10, T11 and T12 (T7–T12). In order to provide suitable base level to the $V_{in,a}$ inputs, the transistors T5,T6 in the differential input voltage stage 60 are preferably of the same type as the transistors T7–T12. The output stage of the multiplier circuit 30 is a current mirror cascode stage. In the cascode stage, transistor F5 conducts the current $I_2$ from node 32, and transistor F7 conducts the current $I_1$ from node 33. Current mirrors F6 and F8 mirror the current $I_2$ to the current $I_1$, so that the difference current $(I_1-I_2)=I_{corr}$ appears on the output node 34. In this manner the multiplier circuit 30 provides a correcting current $I_{corr}$, where $$I_{corr} \sim (V_{in,a} \times V_{in,b}) = V_{in}^2 \sim (I_{ptat}-I_{bg})^2,$$

i.e. the current output of the multiplier 30 is proportional to the squared difference between $I_{ptat}$ and $I_{bg}$. The temperature dependence of the correcting current $I_{corr}$ is shown in FIG. 11, and it is clearly visible that $I_{corr}$ also follows a parabolic function. It must be noted that the apex of the parabola can be positioned very precisely to a well-defined temperature simply be tuning the amplitude of the $I_{ptat}$ and $I_{bg}$ currents relative to each other.

Figure 4:
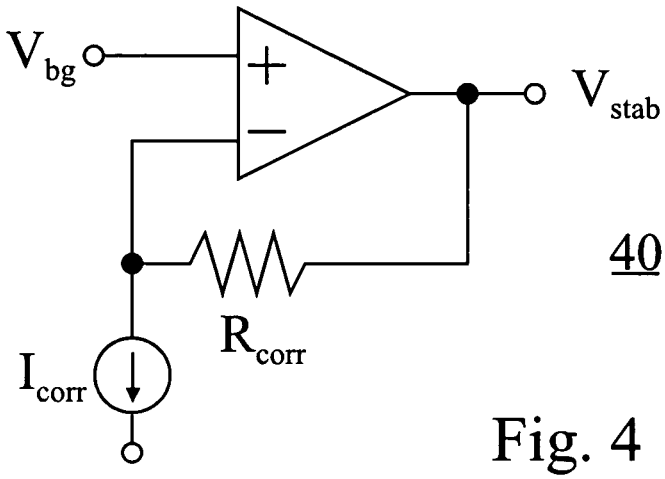
FIG. 4 is a functional schematic diagram of a further part of the circuit of FIG. 1.
Figure 12:
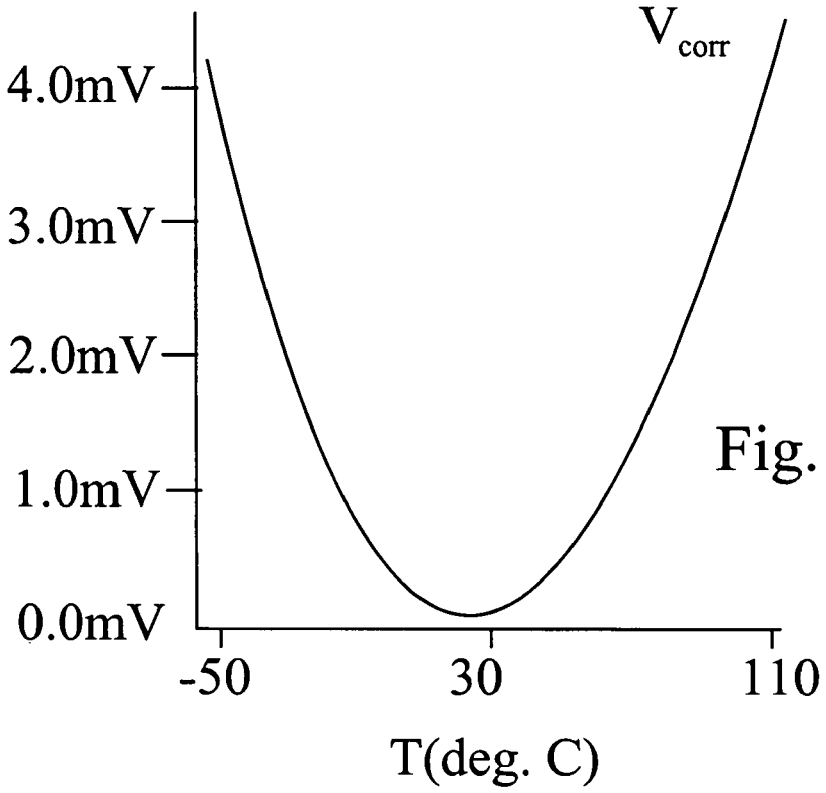
FIG. 12 illustrates the temperature dependence of the $V_{corr}$ voltage converted from the $I_{corr}$ current shown in FIG. 11.

FIG. 4 is a functional block diagram illustrating one example of a circuit that can perform the functions of the current to voltage converter circuit 40 and the adder circuit 50 shown in FIG. 1. The $I_{corr}$ current is forced through a resistor $R_{corr}$ to generate a correcting voltage $V_{corr}$ across the resistor $R_{corr}$. The amplitude of $V_{corr}$ can be tuned independently from the amplitude of the $I_{ptat}$ and $I_{bg}$ currents (by adjusting the value of the resistor $R_{corr}$), and the apex of the second-order curve of $V_{corr}$ may be tuned along the temperature axis by tuning $I_{corr}$, as explained above. This means that the correcting voltage $V_{corr}$ may be adjusted quite precisely to match the shape of the first-order compensated bandgap voltage $V_{bg}$, and good compensation can be achieved, as shown below. The temperature dependence of the correcting voltage $V_{corr}$ is shown in FIG. 12. This correcting voltage $V_{corr}$ is then added to the first order compensated bandgap voltage $V_{bg}$. In the embodiment of circuit 200 shown in FIG. 6, the functions of the basic circuit diagram of FIG. 4 are performed by the op-amp $OA_3$, the current generator IG6, and the resistors $R_{corr}$ and $R_{out}$. The adding of correcting voltage $V_{corr}$ to the bandgap voltage $V_{bg}$ is effected by the op-amp $OA_3$, which effectively subtracts the voltage $V_{corr}$ from the voltage $V_{stab}$. The op-amp $OA_3$ will drive the gate of the current generator IG6 and will force a current through the resistor $R_{out}$ until its inputs are on the same potential, i. e. until the $V_{stab}-V_{corr}=V_{bg}$ equation is satisfied. This means that the stabilized output voltage $V_{stab}$ across the resistor $R_{out}$ will be equal to $(V_{bg}+V_{corr})$. The resulting temperature dependence of the stabilized output voltage $V_{stab}$ is shown in FIG. 13, together with the first order compensated bandgap voltage $V_{bg}$.

Figure 13:
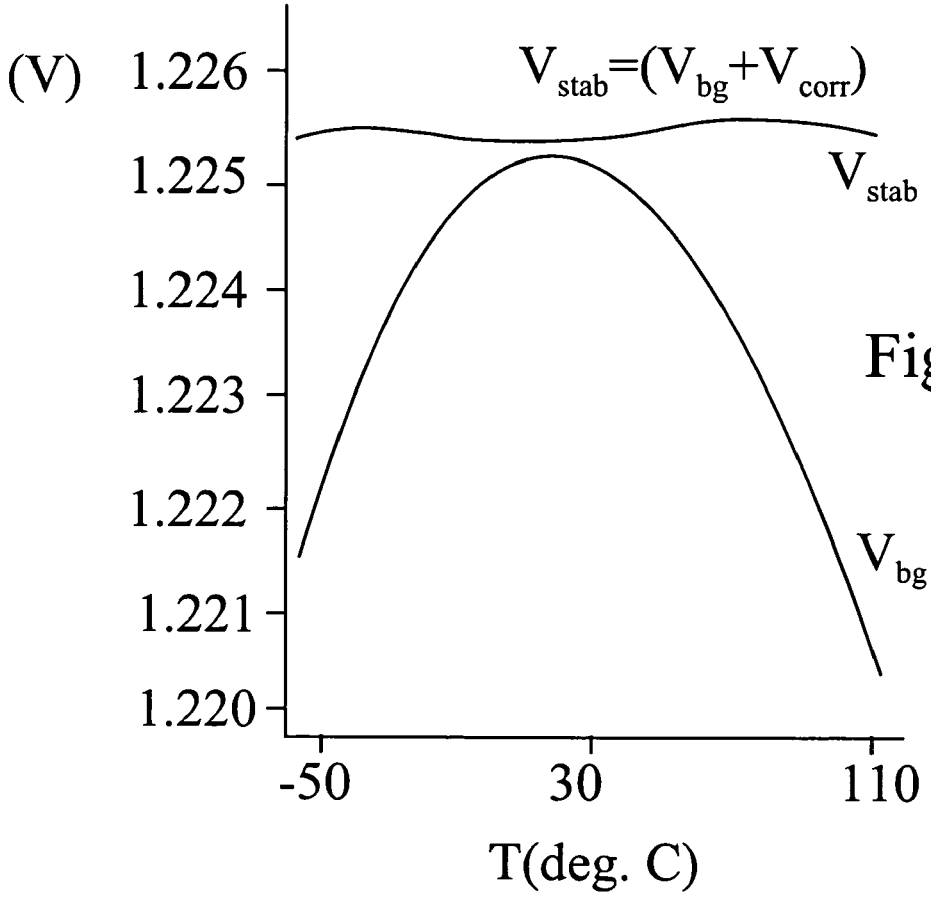
FIG. 13 illustrates the temperature dependence of the first order compensated $V_{bg}$ voltage, and the higher order compensated $V_{stab}$ voltage generated in the circuit of FIG. 6.

As is shown in FIG. 13, the voltage $V_{stab}$ is stable within 1 mV in the temperature range −50–110° C. Within this range, the curve of the stabilized voltage has three extremes, and it is symmetric. Even without any detailed mathematical analysis of the function describing the correcting voltage $V_{corr}$, it is apparent that the curve describing the stabilized voltage $V_{stab}$ is at least a fourth-order curve, with the third-order components in the Taylor series expansion of the curve being either zero or at least negligible. The third order components are negligible because the curve is largely symmetric to a central value in the examined temperature range, hence components having an uneven order are small. The fourth-order components are either negligible or essentially not exceeding the second-order components, because the curve is rather flat, and it is apparent from the shape of $V_{corr}$ that the second-order components in $V_{bg}$ are largely compensated by $V_{corr}$, and therefore second-order components in $V_{stab}$ are also substantially negligible. Accordingly, the proposed circuit and method is capable of compensating the first-order bandgap voltage at least until the third order. However, no higher order transformations, higher than squaring, of either the voltages or currents were necessary to achieve this result.

The invention is not limited to the embodiments shown and disclosed, but other elements, improvements and variations are also within the scope of the invention. For example, it is clear for those skilled in the art that functions of the adder, voltage to current converter and current to voltage converter circuits may be realized in numerous embodiments, instead of the exemplary circuit with the circuit diagram s shown. Also, the disclosed squaring function may be realized in a number of different ways, either as squaring a current or a voltage.

The invention claimed is:

1. A method for generating a higher order compensated bandgap voltage, the method comprising:

generating a first order compensated bandgap voltage;

generating a linearly temperature dependent voltage;

generating a difference voltage based on the difference between the linearly temperature dependent voltage and the first order compensated bandgap voltage;

squaring the difference voltage to create a squared voltage; and adding the squared voltage to the first order compensated bandgap voltage.

2. The method of claim 1, wherein:

the step of generating a first order compensated bandgap voltage further comprises generating a first order compensated bandgap current that is proportional to the first order compensated bandgap voltage;

the step of generating a linearly temperature dependent voltage further comprises generating a linearly temperature dependent current;

the step of generating a difference voltage based on the difference between the linearly temperature dependent voltage and the first order compensated bandgap voltage further comprises generating a difference current based on the difference between the linearly temperature dependent current and the first order compensated bandgap current the step of squaring the difference voltage to create a squared voltage further comprises squaring the difference current to create a squared current; and further includes the step of converting the squared current to a voltage.

3. The method of claim 2, wherein the step of generating a linearly temperature dependent current comprises converting the linearly dependent voltage to current.

4. The method of claim 2, wherein the step of generating a linearly temperature dependent voltage further comprises generating a proportional to absolute temperature (PTAT) current using a transistor.

5. The method of claim 4, wherein the step of generating a proportional to absolute temperature (PTAT) current using a transistor further comprises generating a PTAT current using a bipolar transistor.

6. The method of claim 1, further comprising amplifying at least one of the linearly temperature dependent voltage and the first order compensated bandgap voltage so that the linearly temperature dependent voltage and the first order compensated bandgap voltages are substantially equal in a central region of a compensation temperature range.

7. The method of claim 5, wherein the step of generating a first order compensated bandgap voltage further comprises generating the first order compensated bandgap voltage using at least one bipolar transistor.

8. The method of claim 7, wherein the step of generating a PTAT current using a bipolar transistor further comprises generating a PTAT current using a bipolar transistor having the same structure as at least one of the bipolar transistors used to generate the first order compensated bandgap voltage.

9. The method of claim 7, wherein the step of generating a PTAT current using a bipolar transistor further comprises generating a PTAT current using a bipolar transistors used to generate the first order compensated bandgap voltage.

10. The method of claim 5, wherein the step of generating a proportional to absolute temperature (PTAT) current using a transistor further comprises generating a PTAT current using a plurality of bipolar transistors and generating a PTAT voltage by flowing the PTAT current through a resistor.

11. A higher order temperature compensated bandgap circuit comprising a first order temperature compensated bandgap circuit for generating a first order temperature compensated output voltage;

a current generator circuit for generating a linearly temperature dependent current;

a voltage to current converter circuit for converting to current the first order temperature compensated output voltage and thereby providing a first order temperature compensated bandgap current;

a multiplier circuit for squaring a difference between said first order temperature compensated bandgap current and said linearly temperature dependent current, and for providing a squared current output;

a current to voltage converter circuit for converting to voltage the squared current output of the multiplier circuit for providing a squared voltage output;

an adder circuit for adding the squared voltage output of the current to voltage converter circuit to the first order temperature compensated output voltage of the first order temperature compensated bandgap circuit.

12. The bandgap circuit of claim 11, in which the multiplier circuit comprises a differential voltage input circuit for generating a differential voltage from said linearly temperature dependent current of said current generator and said first order temperature compensated bandgap current of said voltage to current converter circuit.

13. The bandgap circuit of claim 11, in which the linearly temperature dependent current and the first order compensated bandgap current are each fed through the respective resistors of a pair of two substantially equal resistors.

14. The bandgap circuit of claim 11, in which the first order temperature compensated bandgap circuit comprises a first transistor generating a first $I_{ptat}$ current and a second transistor generating a second $I_{ptat}$ current.

15. The bandgap circuit of claim 14, in which the first or second transistor comprises a bipolar transistor.

16. The bandgap circuit of claim 11, further comprising means for amplifying at either or both of the first order compensated bandgap current and the linearly temperature dependent current so that the first order compensated bandgap current and the linearly temperature dependent current are substantially equal to the other current in a central region of a compensation temperature range.

17. The bandgap circuit of claim 16, further comprising either a bandgap current setting resistor or a $I_{ptat}$ current setting resistor, or both.

18. The bandgap circuit of claim 11, in which a linearly temperature dependent voltage is generated with two transistors having different active areas, where two equal $I_{ptat}$ currents flowing through said two transistors establish different basis-emitter voltages on the two transistors, and a difference between the basis-emitter voltages is transformed across a resistor fed with a linearly temperature dependent current.

19. The bandgap circuit of claim 18, in which the linearly temperature dependent current being fed through said resistor is the $I_{ptat}$ current flowing through one of said transistors.

20. The bandgap circuit of claim 18, in which the transistor having a larger active area comprises a plurality of separate and parallel connected transistors.

21. The bandgap circuit of claim 11, in which the voltage to current converter circuit for providing a first order temperature compensated bandgap current comprises an op-amp, which establishes a voltage across a resistor, and thereby generates a current through said resistor.

22. The bandgap circuit of claim 11, in which the first order temperature compensated circuit comprises a transistor, which transistor also generates the linearly temperature dependent current.

23. The bandgap circuit of claim 11, in which the multiplier circuit comprises a four quadrant multiplier.

24. A circuit for generating a higher order compensated bandgap voltage, the circuit comprising:

means for generating a first order compensated bandgap voltage;

means for generating a linearly temperature dependent voltage;

means for generating a difference voltage based on the difference between the linearly temperature dependent voltage and the first order compensated bandgap voltage;

means for squaring the difference voltage to create a squared voltage; and means for adding the squared voltage to the first order compensated bandgap voltage.

25. The circuit of claim 24, wherein:

the means for generating a first order compensated bandgap voltage further comprises means for generating a first order compensated bandgap current that is proportional to the first order compensated bandgap voltage;

the means for generating a linearly temperature dependent voltage further comprises means for generating a linearly temperature dependent current;

the means for generating a difference voltage based on the difference between the linearly temperature dependent voltage and the first order compensated bandgap voltage further comprises means for generating a difference current based on the difference between the linearly temperature dependent current and the first order compensated bandgap current the means for squaring the difference voltage to create a squared voltage further comprises means for squaring the difference current to create a squared current; and further includes means for converting the squared current to a voltage.

26. The method of claim 25, wherein the means for generating a linearly temperature dependent current comprises means for converting the linearly dependent voltage to current.

27. The method of claim 25, wherein the means for generating a linearly temperature dependent voltage further comprises means for generating a proportional to absolute temperature (PTAT) current using a transistor.

28. The method of claim 27, wherein the means for generating a proportional to absolute temperature (PTAT) current using a transistor further comprises means for generating a PTAT current using a bipolar transistor.

29. The method of claim 24, further comprising means for amplifying at least one of the linearly temperature dependent voltage and the first order compensated bandgap voltage so that the linearly temperature dependent voltage and the first order compensated bandgap voltages are substantially equal in a central region of a compensation temperature range.

30. The method of claim 28, wherein the means for generating a first order compensated bandgap voltage further comprises means for generating the first order compensated bandgap voltage using at least one bipolar transistor.

31. The method of claim 30, wherein the means for generating a PTAT current using a bipolar transistor further comprises means for generating a PTAT current using a bipolar transistor having the same structure as at least one of the bipolar transistors used to generate the first order compensated bandgap voltage.

32. The method of claim 30, wherein the means for generating a PTAT current using a bipolar transistor further comprises means for generating a PTAT current using a bipolar transistors used to generate the first order compensated bandgap voltage.

33. The method of claim 28, wherein the means for generating a proportional to absolute temperature (PTAT) current using a transistor further comprises means for generating a PTAT current using a plurality of bipolar transistors and generating a PTAT voltage by flowing the PTAT current through a resistor.

* * * * *